United States Patent [19]

Kozak

[11] Patent Number: 4,851,268

[45] Date of Patent: Jul. 25, 1989

[54] CURTAIN COATING START-UP METHOD AND APPARATUS

[75] Inventor: Stephen J. Kozak, Webster, N.Y.

[73] Assignee: Eastman Kodak Company, Rochester, N.Y.

[21] Appl. No.: 150,176

[22] Filed: Jan. 29, 1988

[51] Int. Cl.[4] ..... B05D 1/30

[52] U.S. Cl. ..... 427/420; 427/411; 430/939; 118/DIG. 4; 118/300

[58] Field of Search ..... 427/420, 411, 407.1, 427/302, 303; 430/939; 118/DIG. 4, 300

[56] References Cited

U.S. PATENT DOCUMENTS

| | | | |
|---|---|---|---|
| 3,242,003 | 3/1966 | Brown | 427/420 |
| 3,508,947 | 4/1970 | Hughes | 118/DIG. 4 |
| 3,986,476 | 10/1976 | Yano et al. | 118/DIG. 4 |

*Primary Examiner*—Shrive Beck

*Attorney, Agent, or Firm*—John B. Turner

[57] ABSTRACT

The start-up of a free-falling liquid curtain (12) in the coating of objects or a moving web (18) using curtain coaters is considerably improved by the controlled retraction of a catch pan device (30) positioned in close proximity to the moving web (18). The catch pan device which includes a primary lip (32), and a secondary lip (44), is positioned so that it can be retracted through the falling curtain at a predetermined speed and direction relative to the moving web (18). The device (30) is retracted at the start of a coating process so that the falling curtain is interrupted first by primary lip (32) and then secondary lip (44). Primary lip (32) prevents the coating liquids from flowing onto the moving web (18) during the start-up process and secondary lip (44) retains the coating liquids of an extended falling curtain resulting from contact between the curtain and primary lip (32). The start up method and apparatus including the catch pan device (30), having a plurality of spaced lips on the trailing end of said device, the orientation of the catch pan device relative to the falling curtain (12) and moving web (18), the retraction speed of the catch pan device and the direction of retraction of the catch pan device relative to the moving web (18), provide a considerably improved uniform coating start-up.

21 Claims, 3 Drawing Sheets

CURTAIN COATING START-UP METHOD AND APPARATUS

FIELD OF THE INVENTION

The present invention relates to a method and apparatus for coating objects or moving webs by the curtain coating method and more particularly to an improved curtain coating method and apparatus for the manufacture of multilayer photographic materials such as photographic film and paper.

BACKGROUND OF THE INVENTION

Hitherto, in aqueous solution systems it is known to use a curtain coating method comprises simultaneously applying silver halide emulsions containing gelatin as a binder using a slide hopper coating apparatus to form a multilayer photographic film or paper. A moving web is coated by a free falling curtain of coating composition wherein a multilayer composition is formed on the slide hopper and caused to impinge onto an object or moving web to form a coated layer thereon. The formation of a composite of a plurality of distinct layers on a moving web is described in Hughes U.S. Pat. No. 3,508,947 issued on Apr. 28, 1970 which relates particularly to the manufacture of multilayer photographic materials such as photographic film and paper.

U.S. Pat. No. 3,508,947 describes a method commonly used to start-up a continuous curtain coating process. A flat curtain deflector is mounted so it can be pivoted or slid into position. During preparation for coating the deflector diverts the free fall of the curtain fluids to flow down the deflector surface into a catch basin. The coating process is started after establishing the stability of the curtain and bringing the web to a normal coating speed. The curtain defector is then retracted by pivoting or sliding it away from the falling curtain to allow the curtain to impinge onto the moving web. The curtain deflector can be located on either the front or back side of the falling curtain. Use of a deflector in this manner results in the accumulation of excess coating liquids on the moving web.

Accumulation of excess coating liquids on the moving web often occur in amounts that result in the generation of large quantities of extremely costly waste, e.g., for each occurrence it is not unusual to have more than a thousand linear meters of wasted coated photographic material.

In addition areas of excessive coating liquids deposited on the web support will often transfer from the web onto the machine rolls used in transporting the moving web and in the wind up end of the machine. Significant operating cost result when the coating process must be stopped to clean the coating machine. Furthermore, it should be appreciated that each new start of a coating process is susceptible to incurring the same problems.

Efficient use of the curtain coating method for manufacturing photographic materials has thus far been adversely effected by the inability to develop efficient coating starts at the intended coating flow rate and web speeds without depositing areas of excessive coating liquid on the web support. Although curtain flow rates and web speeds can be adjusted to reduce contamination of the web transport rolls and coated product, the problem of accumulation of excess coating liquids still exists to a very undesirable extent.

SUMMARY OF THE INVENTION

We have found that excess accumulation of coating liquids on the web during curtain coating start-up is caused by the falling curtain impinging onto a slow moving curtain deflector, as well as the inadequate design and orientation of the deflector. In addition, it was found that the accumulation of coating liquids or "puddles" on the deflector was increased upstream of the falling curtain during retraction of the deflector. This together with the inertia) of the accumulated liquid as the deflector was retracted beneath it, resulted in spill-off of excessive coating liquids on the web. All known curtain coating machines incorporating start-up devices such as a planar curtain deflector are attended by serious disadvantages and therefore are unsatisfactory for making acceptable coating starts.

It is an object of the present invention to provide a curtain coating method and apparatus for the start-up of continuous coating of objects or moving webs to prevent the build up of areas of excess coating liquids onto the moving web.

According to the present invention there is provided a method for curtain coating a moving support which comprises conveying a web over a web supporting roller, forming a free falling curtain of coating composition, the width of said curtain being maintained by edge guides in wetting contact with the curtain edges wherein the start-up of the curtain coating process is achieved by using a downwardly inclined dual pan device closely spaced to the coating roll and positioned to intercept the falling curtain during retraction of said pan in the direction of the moving web.

The present invention also includes within its scope apparatus for carrying out the method for coating a moving web support, which is disclosed herein. In a preferred embodiment this apparatus comprises means for conveying a web over a supporting roller, means for forming a free falling curtain of a coating composition, and edge guide means for maintaining the width of said curtain in wetting contact with the curtain edges wherein the improvement comprises a downwardly inclined catch pan device closely spaced to the coating rolls and positioned to intercept the falling curtain. Said catch pan device is comprised of two spaced lips on the trailing end of said device, the primary lip designed to retain the curtain liquid puddle formed on said device during coating start-up and the secondary lip and pan extension space between the two lips designed to capture the curtain liquids extended from their free fall position as the primary lip intercepts the curtain during retraction of said device. In a preferred embodiment, the invention is accomplished with a catch pan device where the height of the two lips and the pan extension space between the two lips is determined by the time it takes the falling curtain to fall the distance from the top of the primary lip to the inclined pan surface using Newton's free fall equation and the retraction speed of the pan.

BRIEF DESCRIPTION OF THE DRAWINGS

The accompanying drawings will serve to illustrate the method and apparatus of the present invention.

DETAILED DESCRIPTION OF THE INVENTION

The invention will now be described in more detail with reference to the accompanying drawings.

Figure 1:
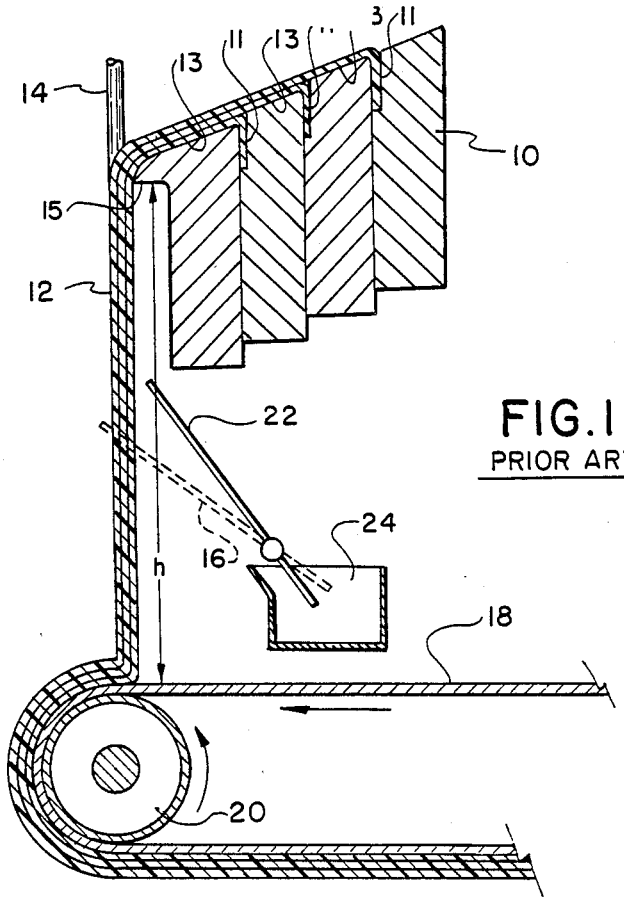
FIG. 1 PRIOR ART
FIG. 1 is a side elevation of a curtain coating apparatus of a slide hopper type showing a free falling curtain held by edge guide rods and impinging on a downwardly inclined start-up deflector positioned above the coating roll.

A known curtain coater of a slide hopper type is shown in FIG. 1. The coating liquids are delivered laterally to the slide hopper 10 ascend to exit slots 11 and are deposited in a form of a layer on the individual inclined surfaces 13. Under the effect of gravity, the individual layers flow down the surfaces 13, flow one another and flow to the coating edge 15 where a free-falling composite curtain 12 is formed. The free-falling composite curtain 12 thus formed drops over a height h and impinges onto the continuously advancing web 18 to form a composite of layers.

At the point where the curtain 12 impinges, the web 18 is preferably guided onto and around a coating roller 20. The width of coating roller can be narrower or wider than the width of the web 18 guided around it. The coating roller 20 is mounted on and preferably driven by a motor which is not shown.

The free-falling liquid curtain 12 is laterally guided by two edge guides 14 and 14' which are vertically arranged and act to hold and stabilize the free falling curtain before the free-falling curtain impinges on the web 18. FIG. 1 shows how a prior art start-up deflector 16 can be pivoted into place to intercept free-falling curtain 12 so that the coating liquids from the free-falling curtain flow down the sloping surface of the deflector and into a container 24. After the free-falling curtain has been stabilized and the web support brought up to coating speed the curtain deflector 22 is retracted until the curtain 12 impinges on the moving web supported by the coating roll 20. The curtain deflector 22 is retracted in a direction which is up and opposite to that of the travel of moving web 18. The start-up deflector 16, 22 usually is positioned as close as possible to the coating roller 20 giving due consideration to the downward inclination of the deflector pan and the orientation of container 24. Practical considerations limit the downward inclination angle of the deflector shown in FIG. 1 to an angle of from 10° to 35°. At angles in this range the coating liquids will tend to accumulate and form a puddle in the area where the free-falling curtain impinges on the deflector surface. For inclination angles less than 10° the puddling and splashing generated by the curtain liquid impinging on the deflector surface is so severe that the curtain cannot be allowed to fall on the pan for more than a second or two or else spillage will occur. Also, when the FIG. 1 deflector is retracted during start-up, the inertia of liquid on the deflector will cause the liquid to be partially spilled on the moving web.

Another problem with the coater illustrated in FIG. 1, is that when the curtain deflector 16, 22 is retracted in a direction opposite to the direction of web travel, the curtain will be deposited on the web prior to the coating application zone. This pre-coating of the web on start-up results in additional excess coating liquid on the support and thus adversely affects the coating at the coating zone. The presence of such pre-coatings will also result in an inability for the curtain to uniformly wet the web and will cause air entrainment between the coating layer and the prewetted support, which show up as coating defects commonly referred to as "wetting failure".

Accordingly, the method and apparatus of my invention is useful in achieving improved uniform start-up of a free falling curtain coating process at the intended coating flow rate and web speed without depositing areas of excessive coating liquids on the web support.

Figure 2:
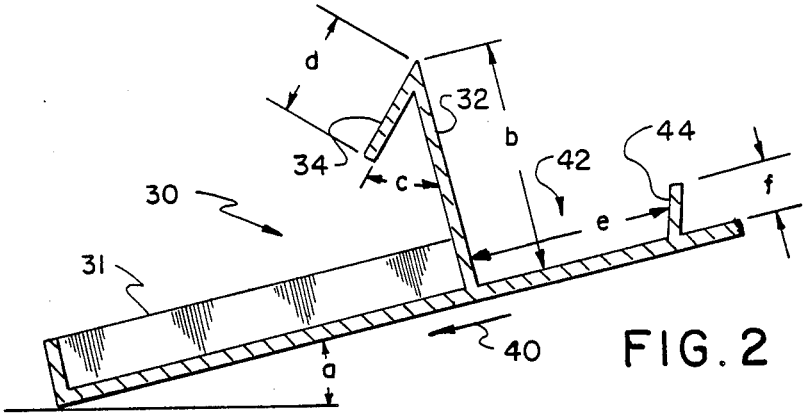
FIG. 2 shows in cross section the dual lip catch pan device according to the present invention.
Figure 5A:
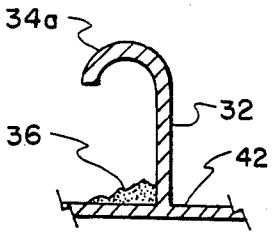
FIG. 5*a*–5*b* shows several embodiments of the primary lip of a catch pan device according to the present invention.
Figure 5B:
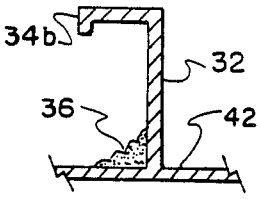

We have discovered that excess coating liquids that could not be satisfactorily retained on prior deflector surfaces can be more effectively retained by means of a catch pan device 30 of a type illustrated in FIG. 2. This embodiment of the present invention comprises a primary lip 32 and a secondary lip 44 which are attached to the trailing end of pan 30. The required height "b" of primary lip 32 depends on the speed of retraction of catch pan 30, the volume of accumulated excess coating liquids, the angle of inclination "a" of the pan, the flow rate of the curtain liquids and the length of time the curtain is allowed to impinge onto the pan surface. The required height of the primary lip 32 can be reduced by including a lip extension 34 inclined at an angle "c" to lip 32 as illustrated in FIG. 2. Other designs of lip 32 and lip extension 34 are equally effective in retaining the puddle on the surface of the catch pan and are shown as additional embodiments of lip extension 34 in FIG. 5.

Figure 3:
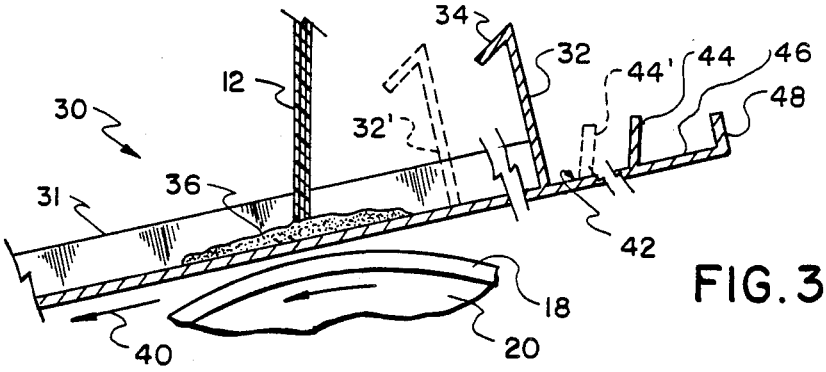
FIG. 3 shows in cross section the curtain puddle formed on the catch pan device during startup.

The action of the primary lip 32 to retain the excess coating liquid illustrated as pudding liquid 36 results from the free-falling curtain 12 impinging on the catch pan 30 and is shown schematically in FIG. 3. Catch pan 30 is positioned in close proximity to the moving web 18 supported by coating roller 20 and retracted in the same direction as the moving web as noted by the direction of arrow 40. Before catch pan 30 retraction is started, the point of impingement of the falling curtain onto the catch pan is positioned a predetermined distance from primary lip 32. This distance depends on the time it takes for acceleration of the catch pan to reach a constant retraction speed. As the catch pan is retracted during start-up, primary lip 32 is positioned at 32' moving towards the puddling area 36 and acts to restrain puddle 36 from being deposited on moving web 18. Continued retraction of catch pan 30 will eventually cause the primary lip 32 to interrupt falling curtain 12 result in the catch pan completely containing puddle area 36. The geometric design of catch pan 30 with a primary lip 32 and side walls 31 is always expected to contain puddle area 36. Height "b" of primary lip 32 can be reduced by the addition of lip extension 34 of length "d".

Figure 4:
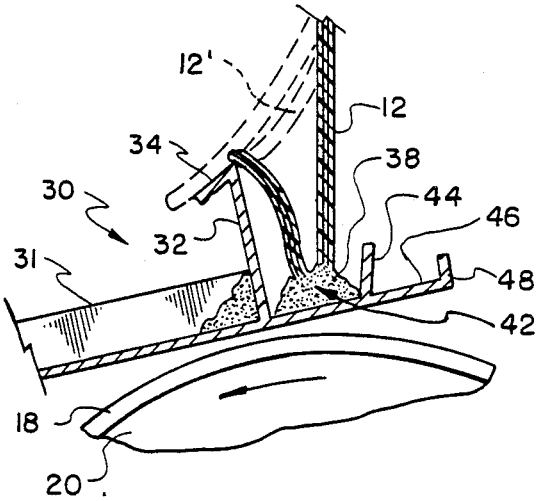
FIG. 4 shows in cross section the extension to the falling curtain formed when the primary lip of the dual catch pan device interrupts the curtain according to the present invention.

Continued retraction of catch pan 30 with its primary lip 32 creates a second source of excess coating liquid to be contained by the catch pan. As shown in FIG. 4 when the primary lip 32 of catch pan 30 penetrates the free falling curtain 12 further retraction of the pan causes the falling curtain to attach to primary lip 32 causing the falling curtain to pull away from its vertical position. As the pan continues to be retracted, the curtain assumes the position 12′ still attached to primary lip 32′. Eventually the curtain breaks and the extended curtain liquids are deposited on the catch pan 30 as a heavy non uniform area of excess coating liquid 38. FIG. 4 shows that extended curtain liquid 38 will be contained by pan extension member 42 by means of secondary lip 44. The height of secondary lip 44 is less than primary 32 since it need only retain the extended curtain liquid 38. Preferably the height of lip 44 should be as small as possible since this lip also tends to create a second curtain extension Referring to FIG. 2 the length "e" of pan extension 42 and height "f" of secondary lip 44 will depend on the speed at which catch pan 30 is retracted during start-up. These dimensions also depend on the time it takes for the extended curtain 12′ to release from primary lip 32.

Figures 6A, 6B, 6C, 6D, 6E, 6F:
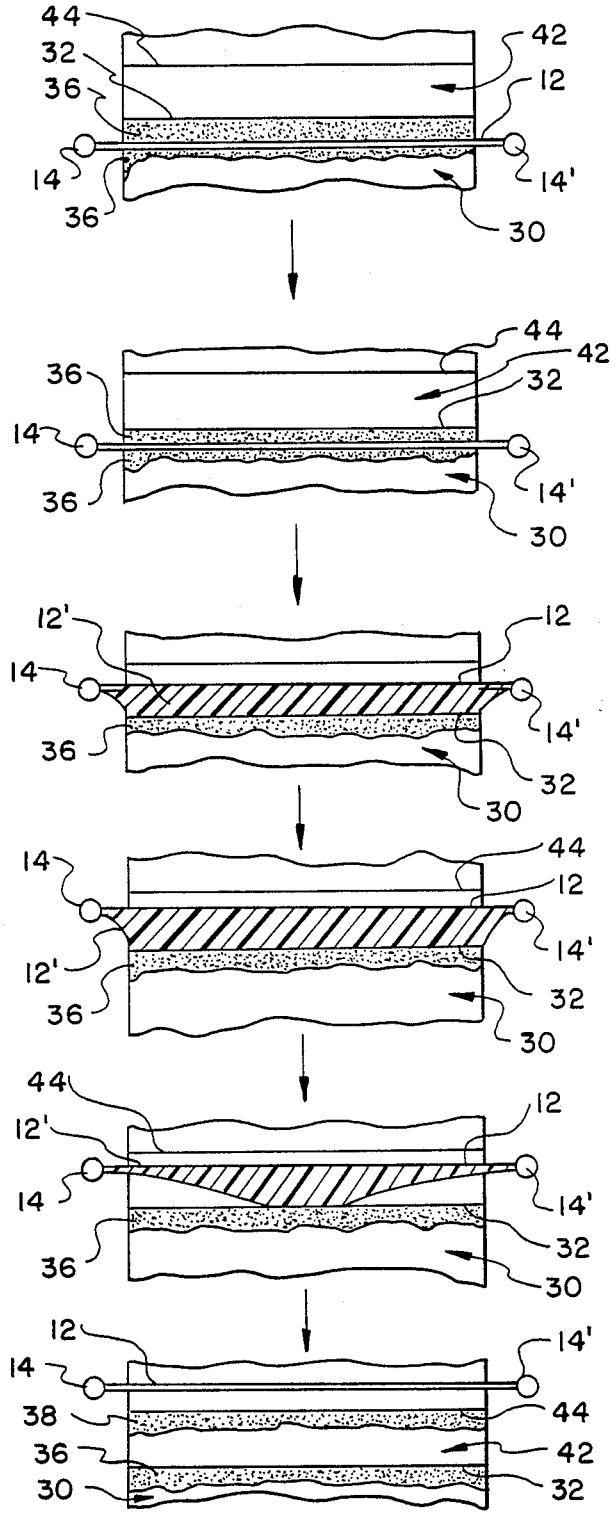
FIG. 6*a*–6*f* is a top view of the impingement of the free-falling curtain during retraction of a catch pan device according to the present invention.

As illustrated in FIG. 6, a top view of the coating position, the falling curtain tends to release from primary lip 32 starting at edge guides 14 and 14′ and eventually releases from the center of primary lip 32. In FIG. 6 the position of retracting catch pan 30 and falling curtain 12 are shown schematically at six different positions of the pan. For all positions 12′ is the falling curtain 12 in its extended condition, 14 and 14′ are edge guides, 30 is the downwardly inclined surface of the catch pan, 32 is a compressed view of the primary lip which includes lip extension 34 and 44 is the secondary lip. FIG. 6*a* shows the position of the catch pan 30 and puddling liquid 36 resulting from the free falling curtain 12 impinging before the retraction of catch pan 30 is started. FIG. 6*b* is the position of the catch pan 30 at the start of retraction before primary lip 32 penetrates falling curtain 12 and shows puddle 36 positioned on the downstream side of primary lip 32. It is a top view of the position of catch pan 30 shown in FIG. 3. FIG. 6*c* is a position of catch pan 30 after primary lip 32 has penetrated falling curtain 12′ and illustrates the extended start of the falling curtain 12′. FIG. 6*d* is the position of catch pan 30 after primary lip 32 has penetrated extended curtain 12′ as it continues to release from the edge of primary lip 32. FIG. 6*e* is the position of catch pan 30 just before extended curtain 12′ releases from the edge of primary lip 32 and FIG. 6*f* is the position of the catch pan 30 after the curtain release is complete and the extended curtain is contained by pan extension member 42 and secondary lip 44. As discussed above, the downwardly inclined catch pan surface is preferably tangent to the coating roller at the point where the falling curtain impinges on the support. The distance between the pan surface and the moving web at the impingement point of the free-falling curtain is preferably 0.6 centimeters or less. The catch pan is kept in close proximity to the moving web so as to avoid any disturbing effects of the falling curtain on the moving web when the catch pan is completely retracted.

The description above illustrates the improved coating starts which are possible when the catch pan of my invention is retracted through a falling curtain. The geometric orientation of the catch pan elements is preferably optimized with respect to the desired operating conditions. The principles of this optimization procedure are now outlined with reference to FIG. 2. The primary lip 32 of the pan functions as a trap for the accumulated coating liquids in the pan. The optimum range for dimension "b" of this lip was found to be 1.5 to 4.0 centimeters. This dimension is determined to be the minimum range needed to prevent liquids from splashing over the lip at the desired speed of pan retraction discussed below. The preferred lip extension 34 "d" has a dimensional range between 0.5 to 1.0 centimeters and an angle "c" range, with primary lip 32, of from 25° to 75°. These dimensions apply when the angle of inclination "a" of the catch pan 30 with the horizontal is in the range of 5°–60°. Several embodiments of lip extensions are illustrated as 34*a* and 34*b* shown in FIG. 5. The same dimensional range "d" can apply to these embodiments with adherence to the need to form an enclosing configuration in order to contain the liquids in the region upstream of adjacent primary lip 32.

Lip extension 34 which first penetrates the curtain preferably is retracted at a rapid speed in order to prevent significant accumulation of coating liquid on the surface of the extension as it passes through and extends the falling curtain during retraction of the catch pan. A retraction speed in the range of 50 and 200 centimeters per second is useful with speeds of 100–125 centimeters per second preferred.

Secondary lip 44 and pan extension 42 are designed to contain falling curtain extension 12′ induced by primary lip 32 and retraction of catch pan 30. The length "e" of the pan extension 42 is related to the pan retraction speed and height "b" of primary lip 32. If the length "e" of the extension is too short the extended curtain will not be captured within the area of extension surface 42. Alternately, extension surface 42 will tend to continue to capture coating liquids of a volume which can not be contained by secondary lip 44. In order to prevent this form happening the minimum length of the pan extension 42 can be calculated by determining the time it takes the curtain to fall the distance from the top of primary lip 32 to the inclined catch pan surface using Newton's free fall equation. This time depends on the catch pan orientation, the primary lip 32 geometry, the catch pan retraction speed and the interception point along the free fall of the curtain.

The length "e" of extension 42 can be calculated from the equation $e = v \times t$ v = retraction speed of catch pan 30 t = time of free fall from the top of primary lip 32 to the inclined catch pan surface.

Curtain heights with free fall in the range of 5–50 centimeters, and with catch pan retraction speeds in the range of 50–200 centimeters per second indicate a required length "e" of the catch pan extension 42 in the range of 1 to 2.5 centimeters. When this procedure is followed the height "f" of secondary lip 44 should be minimized in order to avoid a significant second curtain extension. If necessary a second pan extension member 46 either with or without a further lip 48, as shown in FIG. 3, may be added to the trailing end of the pan to capture additional curtain extensions. Additional pan extension, such as 46, can be added if required, the length of which are smaller than the preceding extension.

The method and apparatus of my invention has been described without reference to any other of the variations in curtain coating method and apparatus. It is useful for the start-up of all known methods and apparatus used for curtain coating a moving web for a plurality of layers which are simultaneously coated as a composite layer, and for any design of a hopper device supplying coating liquids to the curtain, and for any method and apparatus wherein edge guides are used to establish the width of the curtain whether wider or narrower than the web being coated.

EXAMPLE

The following Example illustrates the advantages of the method according to the invention using the described catch pan device for the production of photographic materials. The following dimensions of the catch pan were used in the Example.

| | | |
|---|---|---|
| Catch pan angle of inclination | a | 5° |
| Primary lip height | b | 2.06 cm |
| Pan extension | e | 1.68 cm |
| Secondary lip height | f | 0.3 cm |
| Primary lip extension | d | 0.625 cm |
| Lip extension angle | c | 40° |
| Distance between pan surface and the surface of the moving web | | 0.23 cm |

Example 1

A coater of the type illustrated in FIG. 1 was provided with a catch pan device of the type shown in FIG. 2 used for a three-layer coating. The free-falling curtain height "h" was 25.4 cm and the application point at the mid-point of the coating roll which supports the moving web. The point of impingement of the free calling curtain on the catch pan prior to retraction was 5 cm prior to the primary lip. The speed of retraction of the catch pan device was 125 cm/sec in the same direction as the direction of the moving web. The distance the falling curtain extension was pulled from its vertical fall was 1.2 cm.

The three-layer coating composition consisted of an aqueous gelatin solution having a 30 centipoise viscosity for the bottom layer, a 50 centipoise viscosity for the middle layer and a 70 centipoise viscosity for the top layer. The flow rate for the three-layer composite coating was 4 cubic-centimeters/ centimeter/second.

The coating start was excellent with all excess coating fluids being deposited in the catch-pan device before the catch pan was completely withdrawn and a normal coating operation immediately started. There was insignificant deposition of excess coating fluid on the moving web. Start-up of the curtain coating method could reliably be made without contamination of web transport rolls or waste of large quantities of coated product.

The invention has been described in detail with particular reference to preferred embodiments thereof, but it will be understood that variations and mode functions can be effected within the spirit and scope of the invention as described herein above and as defined in the appended claims.

I claim:

1. A method of improving the start-up of curtain coating a support, comprising the steps of:
(a) moving said support along a path through a coating zone;
(b) forming a plurality of flowing layers of coating liquids to form a composite layer;
(c) forming a free-falling vertical curtain from said composite layer within said coating zone which extends transversely of said path and impinges on said moving support;
(d) intercepting said falling curtain, at a location closely spaced to said support, with a catch pan device having a main catch pan surface and a plurality of spaced lips on the trailing end thereof; and
(e) retracting said catch pan device to move said main surface and lips sequentially through said curtain and out of said curtain whereby said start-up is effected to without the deposition of excess coating liquids on the moving support.

2. A method according to claim 1 wherein the step of retracting is accomplished in the direction of the moving support.

3. A method according to claim 2 wherein, during said retracting step, said falling curtain forms at least one extended curtain by said catch pan device.

4. A method according to claim 2 wherein the steps of intercepting and retracting by said catch pan device is at a speed of 50 to 200 centimeters per second.

5. A method according to claim 1 wherein said coating liquids are photographic coating compositions.

6. A method according to claim 2 wherein the width of said curtain is maintained by edge guides in wetting contact with the curtain edges.

7. Apparatus for improving the start-up of curtain coating a support, comprising:
(a) means for conveying said support along a path through a coating zone;
(b) means for forming a plurality of flowing layers of coating liquids to form a composite layer;
(c) means for forming a free-falling vertical curtain from said composite layer within said coating zone which extends transversely of said path and impinges on said moving support;
(d) means for intercepting said falling curtain prior to impinging on said moving support including a catch pan device with a trailing end having a plurality of spaced lips formed on said trailing end of said device and closely spaced to said support, and
(e) retracting means for moving said spaced lips of said catch pan device so that such lips move through the falling curtain; whereby the falling curtain coats said support without the deposition of excess coating liquids.

8. Apparatus according to claim 7 wherein said retracting means moves said catch pan device in the direction of the moving support.

9. Apparatus according to claim 8 wherein said retraction means moves said catch pan device at a retraction speed in a range of 50 to 200 centimeters per second.

10. Apparatus according to claim 8 wherein said retraction means moves said catch pan device at a retraction speed in the range of 100 to 125 centimeters per second.

11. Apparatus according to claim 7 wherein said means for forming a free-falling vertical curtain includes edge guide means for maintaining the width of said curtain in wetting contact with said edge guide means.

12. Apparatus according to claim 9 wherein said catch pan device includes a primary lip and at least one secondary lip, both said lips intercepting and extending the falling curtain.

13. Apparatus according to claim 12 wherein said primary lip includes a lip extension for retaining coating liquids on the surface of the catch pan device upstream of said primary lip.

14. Apparatus according to claim 13 wherein said lip extension is inclined at an angle of about 25° to 75° relative to said primary lip.

15. Apparatus according to claim 13 wherein said lip extension has a linear dimension of about 0.5 to 1.0 centimeters.

16. Apparatus according to claim 12 said catch pan device includes a pan extension member positioned between said primary lip and said secondary lip for retaining coating liquids from the extended falling curtain.

17. Apparatus according to claim 16 wherein the length e of said pan extension member complies with the relation $e = v \times t$ wherein v = retraction speed of the catch pan and;

t = time of free fall of the curtain from the top of primary lip to the inclined catch pan surface.

18. Apparatus according to claim 17 wherein the length of said pan extension has a linear dimension about 1 to 2.5 centimeters.

19. Apparatus according to claim 17 wherein the angle of inclination with the support of the catch pan device is in a range of about 5–60°.

20. Apparatus according to claim 18 wherein the distance between the catch pan surface and the moving support is preferably 0.6 centimeters or less.

21. Apparatus for improving the start-up of curtain coating by depositing a plurality of coating liquids onto a moving support, comprising:

(a) conveying means including a coating roll for moving said support along a path through a coating zone;

(b) hopper means for forming a plurality of flowing layers of coating liquids to form a composite free-falling curtain which extends transversely of said path and impinges on said moving support;

(c) edge guide means for maintaining the width of said falling curtain in wetting contact with said edge guide means;

(d) catch pan means for intercepting and extending said falling curtain prior to impinging on said moving support wherein said catch pan means includes a trailing end, a primary lip and at least one secondary lip formed on said trailing end of said catch pan means;

(e) said catch pan means further comprising a pan extension positioned between said primary and said secondary lip for retaining coating liquids from the extended falling curtain; and (f) retracting means for moving said catch pan means so that said primary and secondary lips move through the falling curtain ; whereby the falling curtain coats said support without the disposition of excess coating liquids.

* * * * *